US011649679B2

(12) United States Patent
Mathivanan et al.

(10) Patent No.: US 11,649,679 B2
(45) Date of Patent: May 16, 2023

(54) SYSTEM AND METHOD TO AUTOMATICALLY POSITION A MACHINE IN A SHIPPING CONFIGURATION

(71) Applicant: Caterpillar Global Mining Equipment LLC, Denison, TX (US)

(72) Inventors: Saravanan S. Mathivanan, Chennai (IN); Sridhar Thondikulam Raveendran, Chennai (IN); Sudhagar Selvam, Chennai (IN)

(73) Assignee: Caterpillar Global Mining Equipment LLC, Denison, TX (US)

( * ) Notice: Subject to any disclaimer, the term of this patent is extended or adjusted under 35 U.S.C. 154(b) by 10 days.

(21) Appl. No.: 17/150,492

(22) Filed: Jan. 15, 2021

(65) Prior Publication Data

US 2021/0222494 A1 Jul. 22, 2021

(30) Foreign Application Priority Data

Jan. 16, 2020 (IN) ..... 202011002017

(51) Int. Cl.
*E21B 7/02* (2006.01)
*E21B 44/00* (2006.01)

(52) U.S. Cl.
CPC ..... *E21B 7/02* (2013.01); *E21B 44/00* (2013.01)

(58) Field of Classification Search
CPC ..... E21B 7/02; E21B 44/00
See application file for complete search history.

(56) References Cited

U.S. PATENT DOCUMENTS

| | | | | |
|---|---|---|---|---|
| 4,703,811 | A * | 11/1987 | Lam | E02D 7/16 173/195 |
| 7,469,749 | B2 | 12/2008 | Folk | |
| 9,476,256 | B2 | 10/2016 | Pursimo et al. | |
| 9,500,079 | B2 | 11/2016 | Makela | |
| 9,703,290 | B1 * | 7/2017 | Vandapel | E21B 7/02 |
| 10,273,754 | B2 * | 4/2019 | Niemczyk | E21B 7/023 |
| 10,400,571 | B2 | 9/2019 | Evans et al. | |
| 2008/0029606 | A1 | 12/2008 | Marshman | |
| 2018/0216451 | A1 | 8/2018 | Huikkola et al. | |

* cited by examiner

*Primary Examiner* — Dany E Akakpo

(57) ABSTRACT

A machine includes a boom coupled to a movable carrier and at least one boom actuator adapted to actuate the boom. At least one boom sensor is configured to generate signals indicative of a spatial orientation of the boom. A drilling work device is coupled at a distal portion of the boom. First and second actuators are adapted to actuate the drilling work device. At least one drilling work device sensor is configured to generate signals indicative of a spatial orientation of the drilling work device. A controller receives signals indicative of the spatial orientation of the boom, receives signals indicative of the spatial orientation of the drilling work device, and actuates at least one of the at least one boom actuator and the first and second actuators through predetermined sequential steps to automatically position the machine in a shipping configuration.

10 Claims, 8 Drawing Sheets

SYSTEM AND METHOD TO AUTOMATICALLY POSITION A MACHINE IN A SHIPPING CONFIGURATION

TECHNICAL FIELD

The present disclosure relates to a drilling machine. More particularly, the present disclosure relates to automating process of positioning the drilling machine in a shipping configuration.

BACKGROUND

In drilling and other work sites, various drilling vehicles, i.e. mobile drilling machines, are used. The drilling vehicle is provided with a boom and a drilling work machine on the boom. The boom is moved during use between different working positions. Controlling the boom is typically a demanding and time-consuming task, because the boom structure is complex. The boom usually comprises multiple boom actuators and joints the setting of which to a desired position using manual controls is not always intuitive. Furthermore, visibility of the operator to a working site may be poor and available free space is limited.

Typically, at a drilling site using such drilling vehicles, shipping containers are used to transport the drilling vehicles from one location to another. For the drilling vehicle to adequately fit inside the shipping container, the drilling vehicle needs to be within a maximum permissible shipping width, length & height. Exceeding the permitted dimensions may attract financial penalties, therefore it is vital for the drilling machine to be within a shipping envelope. For moving the drilling vehicle from any operating configuration to the shipping configuration, an operator may need to follow various sequential steps so that various front-end implements of the drilling vehicle are within the shipping envelope. Further, the operator needs to avoid any surrounding obstacles, or operator cabin etc. while following such steps making the process highly critical and tedious.

U.S. Pat. No. 9,476,256 (hereinafter called as the '256 reference) discloses a mining vehicle and a method of moving a boom of a mining vehicle. The boom is provided with several boom joints and there is a mining work device at a distal end of the boom. One or more boom joint positions are determined and stored in a memory medium. A control unit of the mining vehicle may automatically move the boom to a predetermined tramming position. Tramming position is defined as a configuration of the mining vehicle to efficiently travel between two mining locations. However, the '256 reference does not disclose about a shipping configuration and problems associated with the same.

Thus, there is a need to provide a drilling vehicle which may be stowed to a shipping configuration efficiently.

SUMMARY

In an aspect of the present disclosure, a machine is provided. The machine includes a movable carrier and a boom coupled to the movable carrier. The machine includes at least one boom actuator adapted to actuate the boom. The machine includes at least one boom sensor configured to generate signals indicative of a spatial orientation of the boom. The machine includes a drilling work device coupled at a distal portion of the boom. The machine includes a first actuator and a second actuator adapted to actuate the drilling work device. The machine includes at least one drilling work device sensor configured to generate signals indicative of a spatial orientation of the drilling work device. The machine further includes a controller communicably coupled to the boom actuator, the boom sensor, the first actuator, the second actuator and the drilling work device sensor. The controller receives signals indicative of the spatial orientation of the boom. The controller receives signals indicative of the spatial orientation of the drilling work device. Further, the controller actuates at least one of the boom actuator, the first actuator and the second actuator based on the received spatial orientation of the boom and the drilling work device through predetermined sequential steps to automatically position the machine in a shipping configuration.

In another aspect of the present disclosure, a method to operate a machine is provided. The machine has a boom and a drilling work device coupled to the boom. The method includes receiving signals indicative of a spatial orientation of the boom by a controller. The boom has at least one boom actuator. The method includes receiving signals indicative of a spatial orientation of the drilling work device by the controller. The drilling work device has a first actuator and a second actuator. The method further includes actuating at least one of the boom actuator, the first actuator and the second actuator by the controller based on the received spatial orientation of the boom and the drilling work device through predetermined sequential steps to automatically position the machine in a shipping configuration.

In yet another aspect of the present disclosure, a computer program is provided. The computer program includes program code means configured to control a machine having a boom and a drilling work device coupled to the boom to execute method steps. The method steps include receiving signals indicative of a spatial orientation of the boom by a controller, wherein the boom has at least one boom actuator. The method steps include receiving signals indicative of a spatial orientation of the drilling work device by the controller, wherein the drilling work device has a first actuator and a second actuator. The method steps further include actuating at least one of the boom actuator, the first actuator and the second actuator by the controller based on the received spatial orientation of the boom and the drilling work device through predetermined sequential steps to automatically position the machine in a shipping configuration.

Other features and aspects of this disclosure will be apparent from the following description and the accompanying drawings.

DETAILED DESCRIPTION

Figure 1:
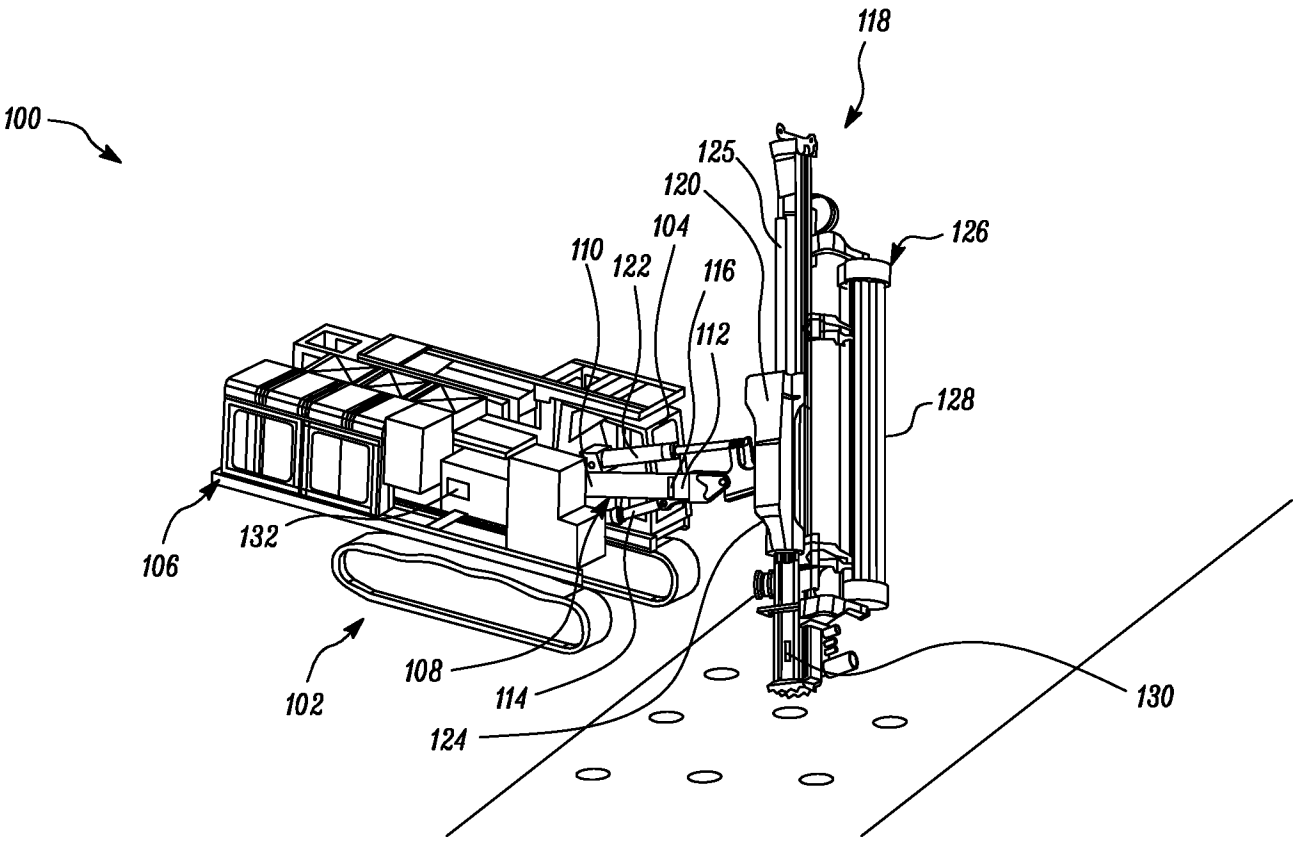
FIG. 1 shows an exemplary machine in an operational configuration, according to an aspect of the present disclosure.
Figure 2:
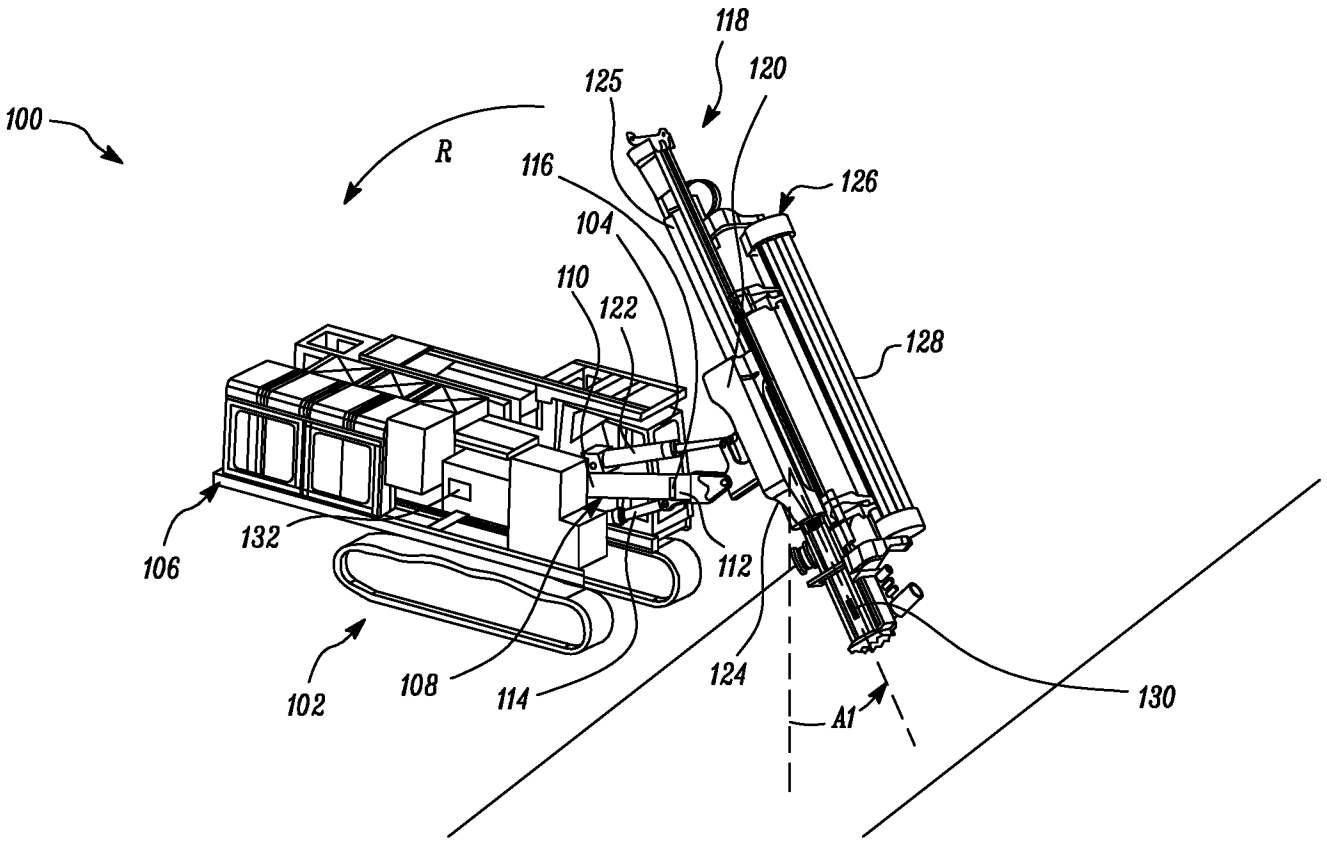
FIGS. 2-6 show the machine in various intermediate configuration, according to an aspect of the present disclosure.

Wherever possible, the same reference numbers will be used throughout the drawings to refer to same or like parts. FIG. 1 illustrates an exemplary machine 100 with which various aspects of the present disclosure may be applied. Although, the machine 100 is illustrated as a down the hole drill machine, the present disclosure may very well be applied with any other suitable machine type as well.

As illustrated in FIG. 1, the machine 100 includes a movable carrier 102. The movable carrier 102 is illustrated as tracks. However, the movable carrier 102 may also be provided as any other suitable alternative such as wheels as per application requirements. The machine 100 includes an operator cabin 104 coupled on the movable carrier 102. A frame 106 of the machine 100 coupled to the movable carrier 102 supports various components on the frame 106. However, such components are not being discussed in detail in the context of present disclosure. The machine 100 further includes a user input interface (not visible) provided within the operator cabin 104. The user input interface may also be provided at a location outside the operator cabin 104 which is easily accessible to an operator.

Figure 7:
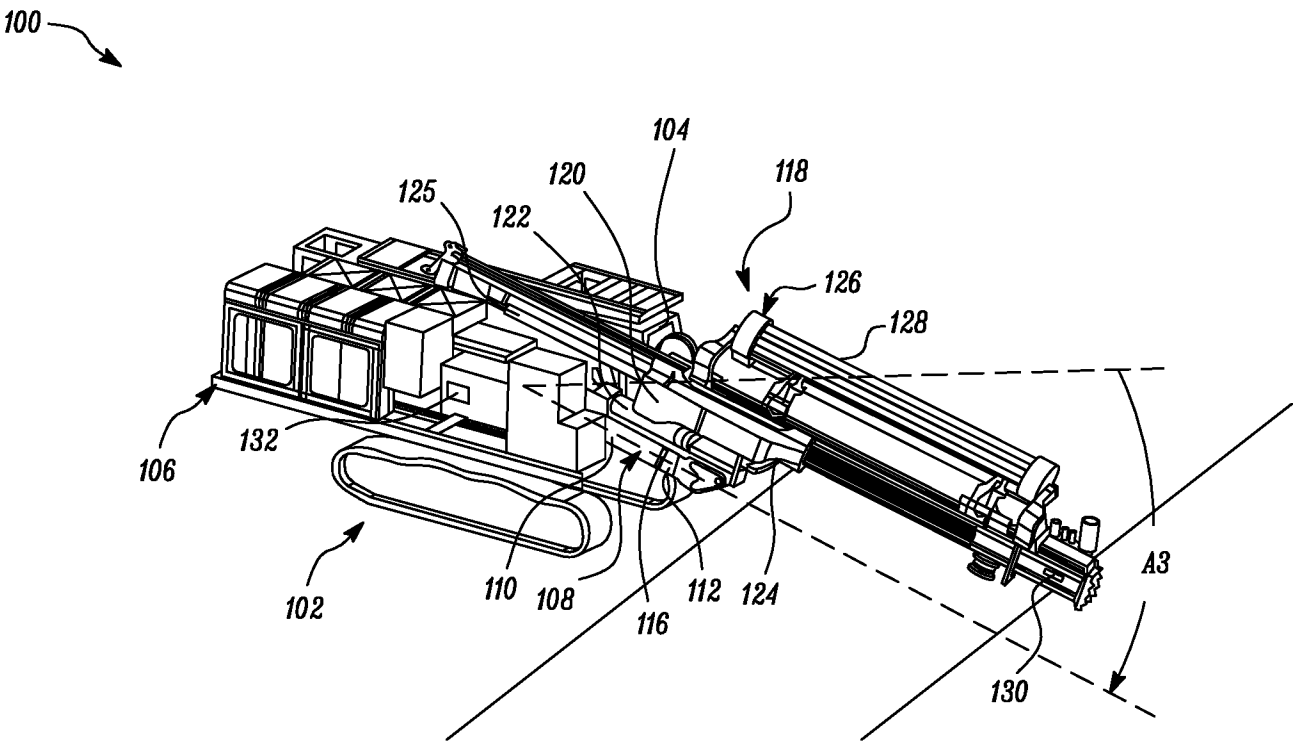
FIG. 7 shows the machine in a shipping configuration, according to an aspect of the present disclosure.

The user input interface may be a button, a joystick, a touchscreen, or any other type of an interface which may be suitable for receiving a user input from an operator. The user input may be various operational inputs required for functioning of the machine 100. In an embodiment, the user input may be an indication that the machine 100 needs to be positioned in a shipping configuration. The shipping configuration may be referred to as a relative positional configuration of various components of the machine 100 such that the machine 100 lies within a shipping envelope and may be placed within a shipping container. (An exemplary such configuration is illustrated in FIG. 7).

The machine 100 includes a boom 108 coupled to the frame 106. The boom 108 has a proximal portion 110 and a distal portion 112. The boom 108 is coupled to the frame 106 at the proximal portion 110 such that the boom 108 is pivoted with the frame 106 at the proximal portion 110. The boom 108 may be moved in a suitable angular range as per application requirements. The machine 100 includes at least one boom actuator 114 which actuates the boom 108. The boom actuator 114 includes a boom lift. The boom lift is illustrated as an extendable piston-cylinder arrangement. The boom actuator 114 may be actuated by hydraulic means, or pneumatic means or any other such suitable means of actuation.

For various operational purposes in context of the present disclosure, it is vital to understand spatial position of the boom 108. The machine 100 includes at least one boom sensor 116 configured to generate signals indicative of a spatial orientation of the boom 108. The boom sensor 116 may be selected from one or more of an inertial measurement unit (IMU), or a proximity sensor. The boom sensor 116 may be any suitable type of sensor which may be applicable with various aspects of the present disclosure. The present disclosure is not limited by type of the boom sensor 116 in any manner. The boom sensor 116 may be attached to the boom 108 at any suitable location between the proximal portion 110 and the distal portion 112.

The machine 100 further includes a drilling work device 118 coupled at the distal portion 112 of the boom 108. The drilling work device 118 includes various components collectively being referred here as the drilling work device 118. In the illustrated embodiment, the drilling work device 118 is used to carry out vertical drilling operation through the various components of the drilling work device 118.

The drilling work device 118 includes a feed table 120 coupled to the distal portion of the boom 108. The machine 100 includes a first actuator 122 which may actuate the drilling device 118 such that the drilling device 118 may be tilted along a first rotational direction R. More specifically, the first actuator 122 actuates the feed table 120 to be tilted along the first rotational direction R. The machine further includes a feed swing actuator 124 as well. The feed swing actuator 124 actuates the drilling work device 118 to control swing of the drilling work device 118.

The feed table 120 supports a drill pipe rack 126 such that the drill pipe rack 126 may slide relative to the feed table 120 as per application requirements. The drill pipe rack 126 supports one or more drill pipes 128 and may be suitably used for supplying, changing or withdrawing the drill pipes 128. The machine 100 further includes a second actuator 125 for supporting sliding motion of the drill pipe rack 126 relative to the feed table 120.

The drilling work device 118 may include various other components as well. However, any such components are not limiting to the context of the present disclosure and are not being discussed in detail here. The machine 100 further includes at least one drilling work device sensor 130. The drilling work device sensor 130 is configured to generate signals indicative of a spatial orientation of the drilling work device 118. The drilling work device sensor 130 may include one or more of an inertial measurement unit, a feed table extend sensor, a proximity sensor etc.

The machine further includes a controller 132. The controller 132 may include a processor (not shown) and a memory (not shown). The memory may include computer executable instructions that are executable by the processor to perform a logic associated with the controller 132. In an example, the controller 132 may include analog-to-digital converters to process the signals from the various components of the machine 100.

The processor and the memory may be in communication with each other. The processor may be in communication with additional components. The processor may be in communication with the user input interface. In some embodiments, the processor may also receive inputs from the operator via the user input interface. The controller 132 may control various parameters of the machine 100 based on the inputs received from the operator.

The processor may be any device that performs logic operations. The processor may include a general processor, a central processing unit, an application specific integrated circuit (ASIC), a digital signal processor, a field programmable gate array (FPGA), a digital circuit, an analog circuit, a controller, a microcontroller, any other type of processor, or any combination thereof. The processor may include one or more components operable to execute computer executable instructions or computer code embodied in the memory.

Some of the features of the controller 132 may be stored in a computer readable storage medium (for example, as logic implemented as computer executable instructions or as data structures in memory). All or part of the controller 132 and its logic and data structures may be stored on, distributed across, or read from one or more types of computer readable storage media. Examples of the computer readable storage medium may include a hard disk, a floppy disk, a CD-ROM, a flash drive, a cache, volatile memory, non-volatile memory, RAM, flash memory, or any other type of computer readable storage medium or storage media. The computer readable storage medium may include any type of non-transitory computer readable medium, such as a CD-ROM, a volatile memory, a non-volatile memory, ROM, RAM, or any other suitable storage device.

A network interface (not shown) may facilitate communication of the controller 132 with a packet-based network, such as a local area network. Additionally, peripheral interfaces (not shown) may be provided. For example, the peripheral interfaces may include RS232 serial interfaces to connect the controller 132 to the other parts of the machine 100 to allow control thereof. The peripheral interfaces may further include Universal Serial Bus (USB) interfaces to facilitate connection of human interface devices to the controller, along with a Video Graphics Array (VGA) interface to allow connection of a display (e.g., the user interface) to the controller 132.

The controller 132 is communicably coupled to the boom actuator 114, the boom sensor 116, the first actuator 122, the second actuator 125 and the drilling work device sensor 130. The controller 132 is configured to receive signals indicative of the spatial orientation of the boom 108. The controller 132 receives signals indicative of the spatial orientation of the boom 108 from the boom sensor 116. The controller 132 is configured to receive signals indicative of the spatial orientation of the drilling work device 118. The controller 132 receives signals indicative of the spatial orientation of the drilling work device 118 from the drilling work device sensor 130.

The controller 132 may further receive user input through the user input interface. In an embodiment, the user input is indicative of positioning the machine 100 in the shipping configuration. The controller 132 is further configured to actuate one or more of the boom actuator 114, the first actuator 122 and the second actuator 125 based on the received spatial orientation of the boom 108 and the drilling work device 118 and the user input. The controller 132 actuates the boom actuator 114, the first actuator 122, and the second actuator 125 through predetermined sequential steps.

The pre-determined sequential steps may be stored within the memory of the controller 132 or may be accessible to the controller 132 from an off-board location. The pre-determined steps may be defined by taking into account various structural and operational aspects of the machine 100, as well as compliance regulations of shipping logistics. FIGS. 1 to 6 illustrate various intermediate configurations of the machine 100 achieved through movement of various components to finally arrive at the shipping configuration. It should be contemplated that the illustrated predetermined sequential steps are merely exemplary in nature and the present disclosure is not limited to the illustrated exemplary steps only. Various such sequences may be defined based on several parameters related to the machine 100 and the shipping logistics and may very well be implemented with several aspects of the present disclosure.

FIG. 1 illustrates the machine 100 such that the machine 100 may be in an operational configuration for a drilling operation. The drilling work device 118 is shown in a vertical configuration. When the controller 132 receives the user input that the machine 100 is to be positioned in the shipping configuration, the controller 132 starts executing the predetermined sequential steps. The predetermined sequential steps include the controller 132 actuating the boom actuator 114 to raise the boom 108. In an embodiment, the boom 108 is raised by a first pre-determined angle $A_1$. The first pre-determined angle $A_1$ may be provided in a range based on various structural aspects of the machine 100, as well as several other relevant parameters. The boom 108 is illustrated as raised by the first pre-determined angle $A_1$ in FIG. 2.

Figure 3:
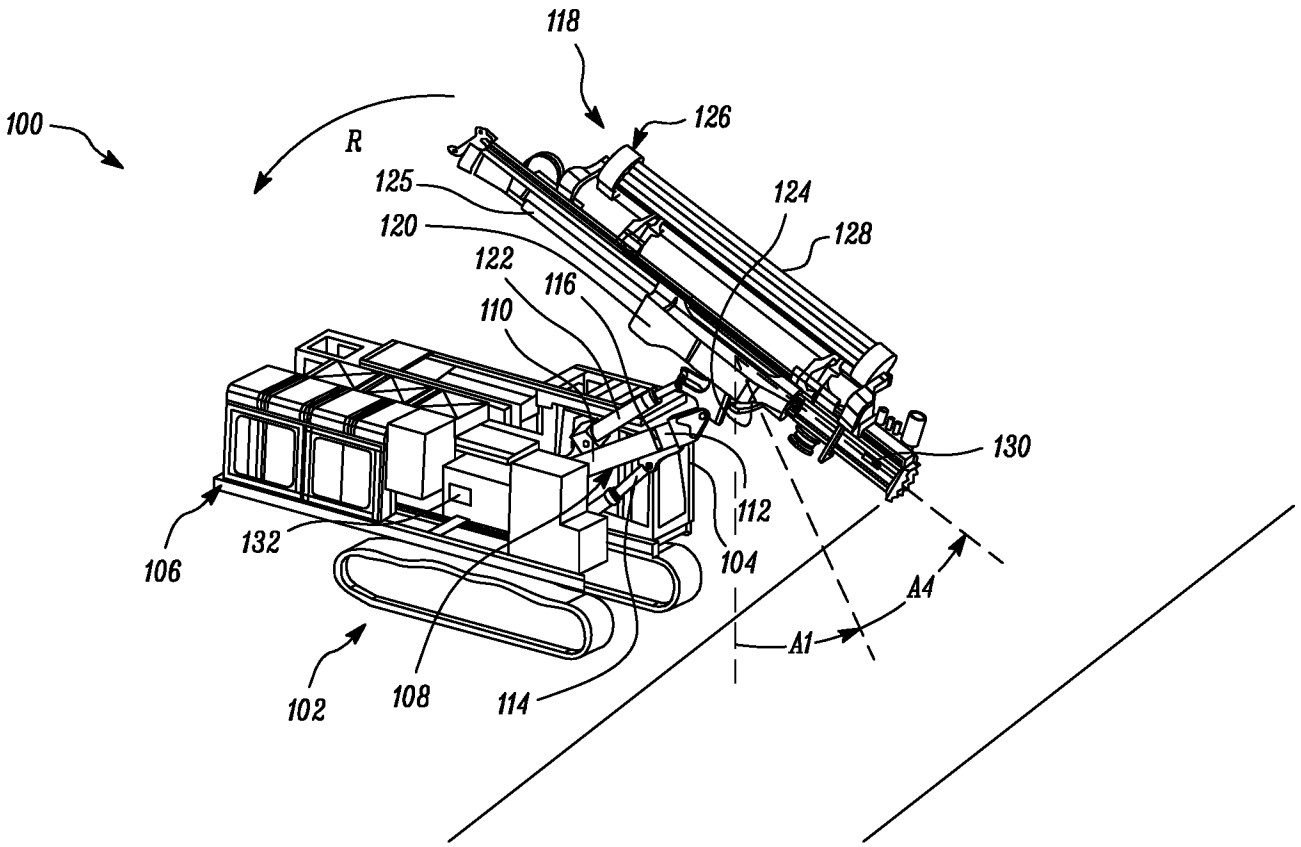
Figure 4:
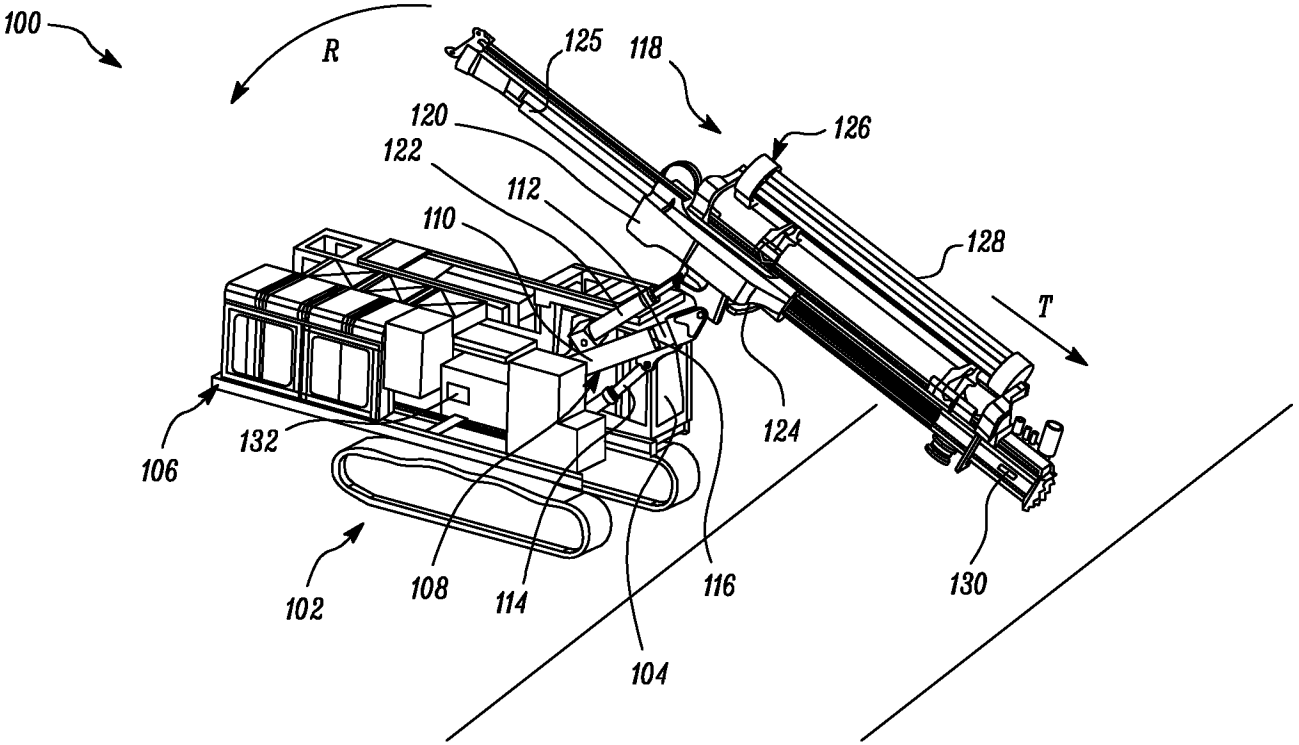

Referring to FIG. 3, the predetermined sequential steps further include the controller 132 actuating the first actuator 122 to tilt the drilling work device 118. The drilling work device 118 is tilted in the first rotational direction R. In an embodiment, the drilling work device 118 is tilted by a fourth pre-determined angle $A_4$. The fourth pre-determined angle $A_4$ may be provided in a range based on various structural aspects of the machine 100, as well as several other relevant parameters. The drilling work device 118 is illustrated as tilted by the fourth pre-determined angle $A_4$ in FIG. 3.

Referring to FIG. 3, the predetermined sequential steps further include the controller 132 actuating the second actuator 125 to translate a portion of the drilling work device 118 in a first translational direction T. In the illustrated embodiment, the portion of the drilling work device 118 is the drill pipe rack 126 which is translated in the first translational direction T over the feed table 120. The drilling work device 118 is illustrated with the drill pipe rack 126 translated in FIG. 4.

Figure 5:
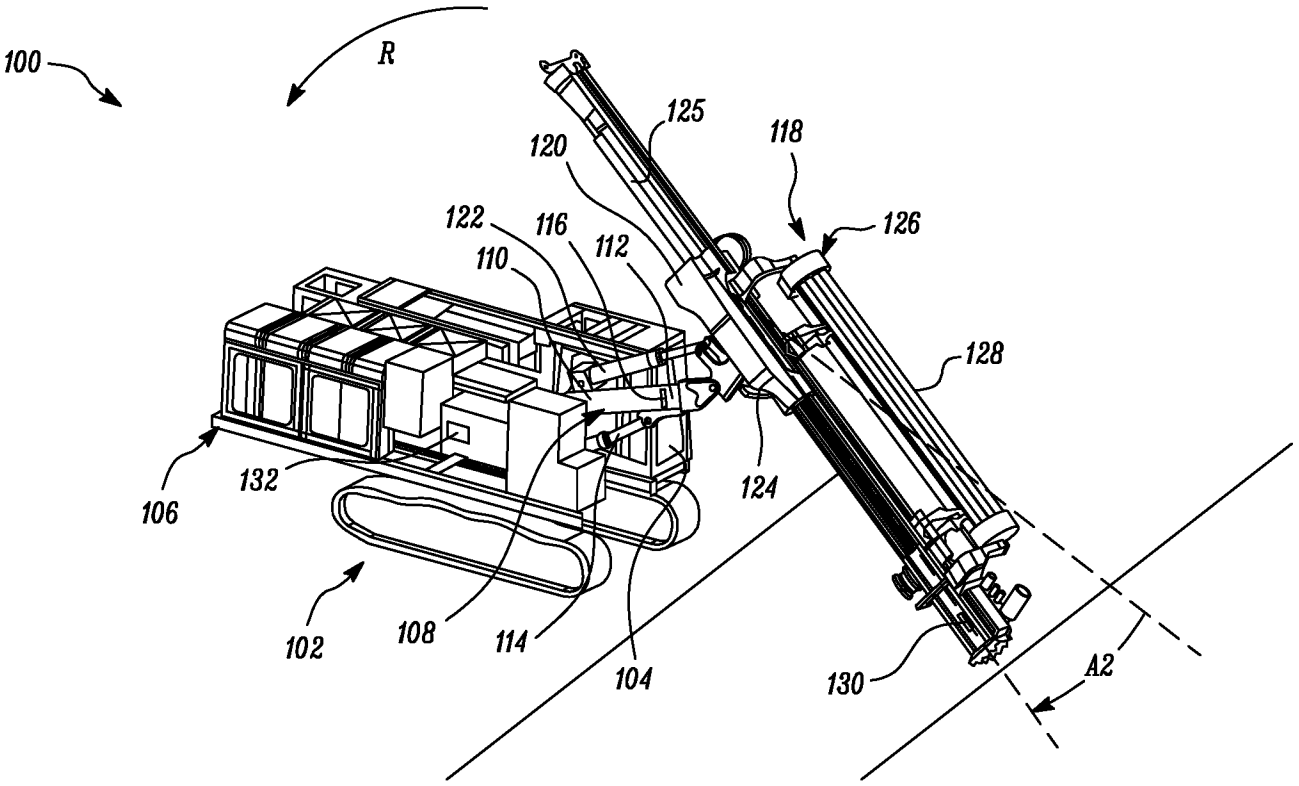

Referring to FIG. 5, the predetermined sequential steps further include the controller 132 actuating the boom actuator 114 to lower the boom 108. In an embodiment, the boom 108 is lowered by a second pre-determined angle $A_2$. The second pre-determined angle $A_2$ may be provided in a range based on various structural aspects of the machine 100, as well as several other relevant parameters. The boom 108 is illustrated as lowered by the second pre-determined angle $A_2$ in FIG. 5.

Figure 6:
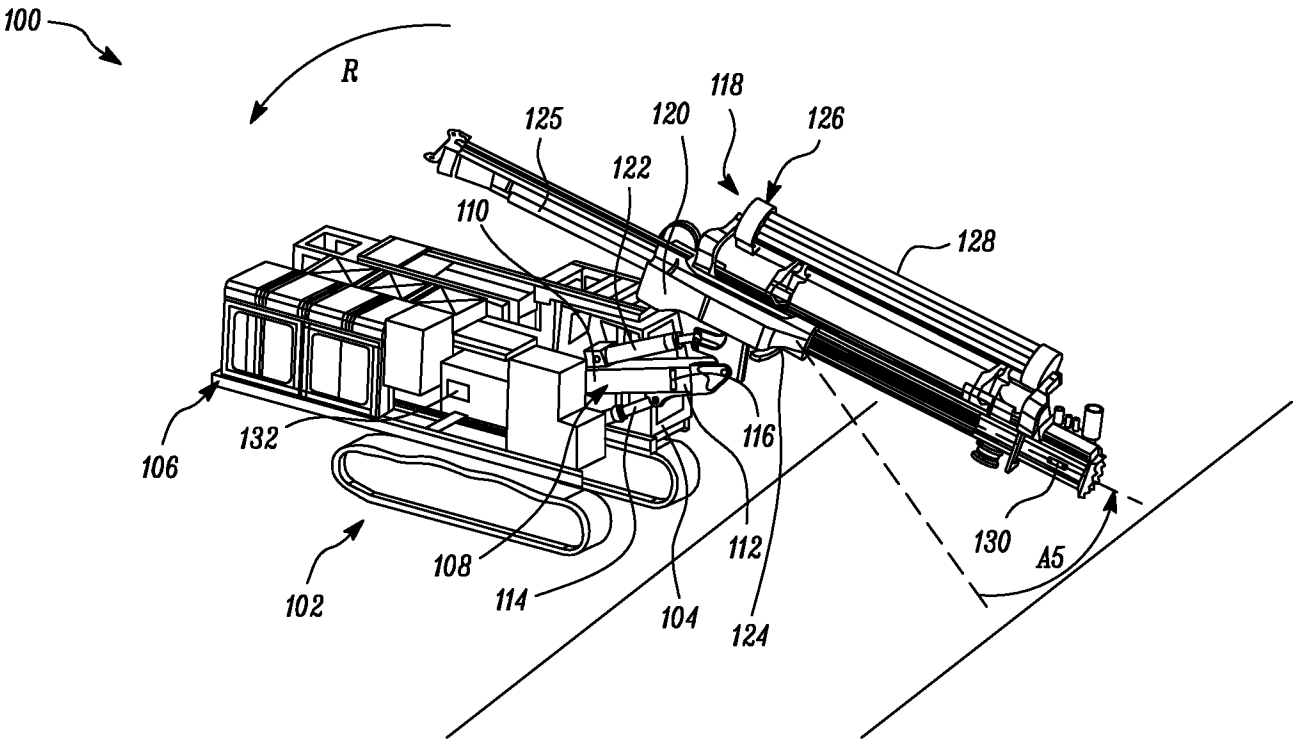

Referring to FIG. 6, the predetermined sequential steps further include the controller 132 actuating the first actuator 122 to further tilt the drilling work device 118. The drilling work device 118 is further tilted in the first rotational direction R. In an embodiment, the drilling work device 118 is further tilted by a fifth pre-determined angle $A_5$. The fifth pre-determined angle $A_5$ may be provided in a range based on various structural aspects of the machine 100, as well as several other relevant parameters. The drilling work device 118 is illustrated as further tilted by the fifth pre-determined angle $A_5$ in FIG. 6.

The predetermined sequential steps further include the controller 132 actuating the boom actuator 114 to further lower the boom 108. In an embodiment, the boom 108 is further lowered by a third pre-determined angle $A_3$. The third pre-determined angle $A_3$ may be provided in a range based on various structural aspects of the machine 100, as well as several other relevant parameters.

The boom 108 is illustrated as further lowered by the third pre-determined angle $A_3$ in FIG. 7 which is also referred to as the shipping configuration in context of the present disclosure. The shipping configuration may be envisioned as a compact relative positioning of various components of the machine 100 which may be suitable for transportation purposes and takes up minimum possible space requirements as well as remains compliant with regulations of the shipping containers and logistics.

The user input interface may receive the user input indicative of positioning the machine 100 in the shipping configuration. The operator may merely press a button and the controller 132 automatically positions the machine 100 in the shipping configuration by following the pre-defined sequence of steps. This saves a lot of time and manual adjustment effort and prevents operator fatigue which leads to increased productivity. Further, as the process is automated, improved repeatability and standardization is observed in stowing the machine 100 in the shipping configuration.

Figure 8:
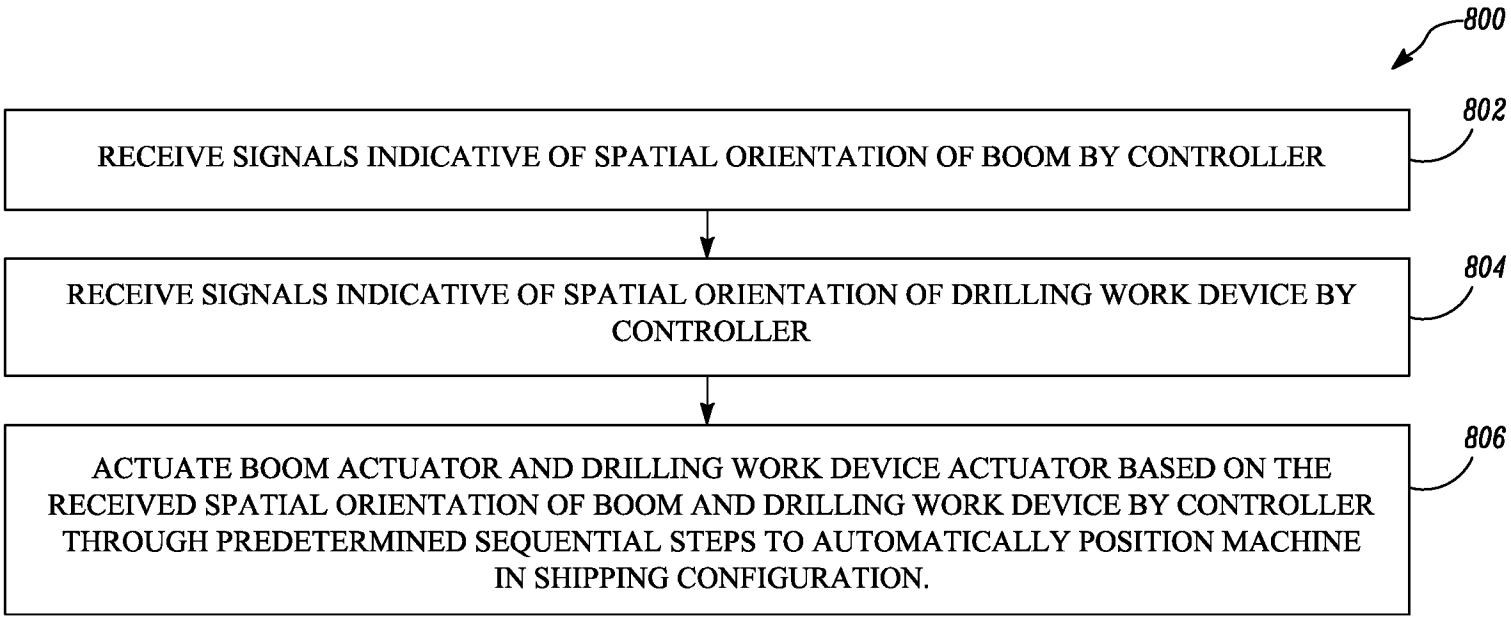
FIG. 8 illustrates method flow chart for controlling the machine, according to an aspect of the present disclosure.

FIG. 8 illustrates a flowchart depicting steps of a method 800 to operate the machine 100. The machine 100 includes the boom 108 and the drilling work device 118 coupled to the boom 108. At step 802, the method 800 includes receiving the signals indicative of the spatial orientation of the boom 108 by the controller 132. The boom 108 has the boom actuator 114 for actuating the boom 108. At step 804, the method 800 includes receiving the signals indicative of the spatial orientation of the drilling work device 118 by the controller 132. The drilling work device 118 has the first actuator 122 and the second actuator 125. At step 806, the method 800 includes actuating one or more of the boom actuator 114, the first actuator 122 and the second actuator 125 by the controller 132 based on the received spatial orientation of the boom 108 and the drilling work device 118 through predetermined sequential steps to automatically position the machine 100 in the shipping configuration.

The method 800 may further include receiving the user input indicating to position the machine 100 in the shipping configuration by the controller 132 and executing the predetermined sequential steps based on the user input to position the machine 100 in the shipping configuration. The predetermined sequential steps include actuating the boom actuator 114 to raise the boom 108. In an embodiment, the boom 108 may be raised by the first pre-determined angle $A_1$. The predetermined sequential steps include actuating the first actuator 122 to tilt the drilling work device 118 in the first rotational direction R. In an embodiment, the drilling work device 118 may be tilted by the fourth pre-determined angle $A_4$.

The predetermined sequential steps include actuating the second actuator 125 to translate the portion of the drilling work device 118 in the first translational direction T. The predetermined sequential steps include actuating the boom actuator 114 to lower the boom 108. In an embodiment, the boom 108 is lowered by the second pre-determined angle $A_2$. The predetermined sequential steps include actuating the first actuator 122 to further tilt the drilling work device 118 in the first rotational direction R. In an embodiment, the drilling work device 118 is further tilted by the fifth pre-determined angle $A_5$. The predetermined sequential steps further include actuating the boom actuator 114 to further lower the boom 108. In an embodiment, the boom 108 is lowered by the third pre-determined angle $A_3$.

Another aspect of the present disclosure is provided as a computer program. The computer program includes program means configured to control the machine 100. The machine 100 has the boom 108 and the drilling work device 118 coupled to the boom 108. The program means is configured to control the machine 100 to execute method steps including receiving the signals indicative of the spatial orientation of the boom 108 by the controller 132. In an embodiment, the signals indicative of the spatial orientation of the boom 108 are received by the boom sensor 116. The boom 108 has the boom actuator 114 for actuating the boom 108. The method steps include receiving the signals indicative of the spatial orientation of the drilling work device 118 by the controller 132. In an embodiment, the signals indicative of the spatial orientation of the drilling work device 118 are received by the drilling work device sensor 130. The drilling work device 118 has the first actuator 122 and the second actuator 125. The method steps include actuating one or more of the boom actuator 114, the first actuator 122 and the second actuator 125 by the controller 132 based on the received spatial orientation of the boom 108 and the drilling work device 118 through predetermined sequential steps to automatically position the machine 100 in the shipping configuration.

The method steps may further include receiving the user input indicating to position the machine 100 in the shipping configuration by the controller 132 and executing the predetermined sequential steps based on the user input to position the machine 100 in the shipping configuration. The predetermined sequential steps include actuating the boom actuator 114 to raise the boom 108. In an embodiment, the boom 108 may be raised by the first pre-determined angle $A_1$. The predetermined sequential steps include actuating the first actuator 122 to tilt the drilling work device 118 in the first rotational direction R. In an embodiment, the drilling work device 118 may be tilted by the fourth pre-determined angle $A_4$.

The predetermined sequential steps include actuating the second actuator 125 to translate the portion of the drilling work device 118 in the first translational direction T. The predetermined sequential steps include actuating the boom actuator 114 to lower the boom 108. In an embodiment, the boom 108 is lowered by the second pre-determined angle $A_2$. The predetermined sequential steps include actuating the first actuator 122 to further tilt the drilling work device 118 in the first rotational direction R. In an embodiment, the drilling work device 118 is further tilted by the fifth pre-determined angle $A_5$. The predetermined sequential steps further include actuating the boom actuator 114 to further lower the boom 108. In an embodiment, the boom 108 is lowered by the third pre-determined angle $A_3$.

The program code means is further configured to cause the machine 100 to perform the method step of receiving the user input by the controller 132 indicating to position the machine 100 in the shipping configuration and executing the predetermined sequential steps by the controller 132 based on the user input to position the machine 100 in the shipping configuration.

INDUSTRIAL APPLICABILITY

The present disclosure provides a user with an option to automate sequential motion steps which need to be completed manually otherwise. After a user has decided that the machine 100 has to be shipped, the user may load the machine 100 on a loading vehicle such as a truck (not shown). After loading the machine 100 on the loading vehicle, the user may actuate the auto shipping sequence by merely pressing a button, or through any other suitable user interface option. The operator need not adjust various components manually, thus considerably saving effort, time and operator fatigue. Automating the shipping mode setup for the machine 100 also improves repeatability of the shipping process, improves accuracy and enhances overall productivity.

While aspects of the present disclosure have been particularly shown and described with reference to the embodiments above, it will be understood by those skilled in the art that various additional embodiments may be contemplated by the modification of the disclosed machines, systems and methods without departing from the spirit and scope of what is disclosed. Such embodiments should be understood to fall within the scope of the present disclosure as determined based upon the claims and any equivalents thereof.

What is claimed is:

1. A machine comprising:

a movable carrier;

a frame supported on the movable carrier;

a boom coupled to the frame;

at least one boom actuator adapted to actuate the boom;

at least one boom sensor configured to generate signals indicative of a spatial orientation of the boom;

a drilling work device coupled at a distal portion of the boom;

a first actuator adapted to actuate the drilling work device;

a second actuator adapted to actuate the drilling work device;

at least one drilling work device sensor configured to generate signals indicative of a spatial orientation of the drilling work device;

the at least one boom sensor is an inertial measurement unit sensor and the at least one drilling work device sensor is also an inertial measurement unit sensor; and a controller communicably coupled to the at least one boom actuator, the at least one boom sensor, the first actuator, the second actuator and the at least one drilling work device sensor, the controller configured to:

receive signals indicative of the spatial orientation of the boom;

receive signals indicative of the spatial orientation of the drilling work device;

actuate at least one of the at least one boom actuator, the first actuator and the second actuator based on the received spatial orientation of the boom and the drilling work device through predetermined sequential steps to automatically position the machine in a shipping configuration such that the machine is configured to lie within the constraints of a shipping container, the sequential steps include:

the boom being raised by a first pre-determined angle, lowered by a second pre-determined angle and further lowered by a third pre-determined angle; and the drilling work device is tilted by a fourth pre-determined angle and further tilted by a fifth pre-determined angle.

2. The machine of claim 1, wherein the predetermined sequential steps include the controller to:

actuate the at least one boom actuator to raise the boom;

actuate the first actuator to tilt the drilling work device in a first rotational direction;

actuate the second actuator to translate at least a portion of the drilling work device in a first translational direction;

actuate the at least one boom actuator to lower the boom;

actuate the first actuator to further tilt the drilling work device in the first rotational direction; and actuate the at least one boom actuator to further lower the boom.

3. The machine of claim 1, further comprising a user input interface configured to provide a user input indicating to position the machine in the shipping configuration.

4. The machine of claim 3, wherein the controller is further configured to execute the predetermined sequential steps based on the user input to position the machine in the shipping configuration.

5. A method to operate a machine, the machine having a boom and a drilling work device coupled to the boom, the method comprising:

receiving, by a controller, signals indicative of a spatial orientation of the boom, wherein the boom has at least one boom actuator;

receiving, by the controller, signals indicative of a spatial orientation of the drilling work device, wherein the drilling work device has at least a first actuator, and a second actuator; and actuating, by the controller, at least one of the at least one boom actuator, first actuator and the second actuator based on the received spatial orientation of the boom and the drilling work device through predetermined sequential steps to automatically position the machine in a shipping configuration within constraints of a shipping container;

the controller receiving the spatial orientation of the boom and drilling device from an at least one boom sensor and an at least one drilling work device sensor that are both inertial measurement unit sensors the boom being raised by a first pre-determined angle, lowered by a second pre-determined angle and further lowered by a third pre-determined angle; and the drilling work device is tilted by a fourth pre-determined angle and further tilted by a fifth pre-determined angle.

6. The method of claim 5, wherein the predetermined sequential steps include:

actuating the at least one boom actuator to raise the boom;

actuating the first actuator to tilt the drilling work device in a first rotational direction;

actuating the second actuator to translate at least a portion of the drilling work device in a first translational direction;

actuating the at least one boom actuator to lower the boom;

actuating the first actuator to further tilt the drilling work device in the first rotational direction; and actuating the at least one boom actuator to further lower the boom.

7. The method of claim 5, further comprising:

receiving, by the controller, a user input indicating to position the machine in the shipping configuration; and executing, by the controller, the predetermined sequential steps based on the user input to position the machine in the shipping configuration.

8. A computer program, the computer program comprising:

program code means configured to control a machine having a boom and a drilling work device coupled to the boom to execute method steps of:

receiving, by a controller, signals indicative of a spatial orientation of the boom, wherein the boom has at least one boom actuator;

receiving, by the controller, signals indicative of a spatial orientation of the drilling work device, wherein the drilling work device has a first actuator and a second actuator;

actuating, by the controller, at least one of the at least one boom actuator, the first actuator and the second actuator based on the received spatial orientation of the boom and the drilling work device through predetermined sequential steps to automatically position the machine in a shipping configuration within constraints of a shipping container;

the controller receiving the spatial orientation of the boom and drilling device from an at least one boom sensor and an at least one drilling work device sensor are an inertial measurement unit sensor;

the boom being raised by a first pre-determined angle, lowered by a second pre-determined angle and further lowered by a third pre-determined angle; and the drilling work device is tilted by a fourth pre-determined angle and further tilted by a fifth pre-determined angle; and wherein the signals indicative of the spatial orientation of the boom and the drilling work device are generated by at least one boom sensor and at least one drilling work device sensor selected from one or more of an inertial measurement unit, and a proximity sensor.

9. The computer program of claim 8, wherein the predetermined sequential steps include the controller to:

actuate the at least one boom actuator to raise the boom;

actuate the first actuator to tilt the drilling work device in a first rotational direction;

actuate the second actuator to translate at least a portion of the drilling work device in a first translational direction;

actuate the at least one boom actuator to lower the boom;

actuate the first actuator to further tilt the drilling work device in the first rotational direction; and actuating the at least one boom actuator to further lower the boom.

10. The computer program of claim 8, wherein the program code means is further configured to cause the machine to perform the method step of:

receive, by the controller, a user input indicating to position the machine in the shipping configuration; and execute, by the controller, the predetermined sequential steps based on the user input to position the machine in the shipping configuration.

* * * * *